US012392344B2

(12) United States Patent
Son et al.

(10) Patent No.: US 12,392,344 B2
(45) Date of Patent: Aug. 19, 2025

(54) ELECTRIC COMPRESSOR

(71) Applicant: Hanon Systems, Daejeon (KR)

(72) Inventors: Eun Gi Son, Daejeon (KR); Seung Kyu Na, Daejeon (KR); Bok Ki Park, Daejeon (KR); You Cheol Jeong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/723,666

(22) PCT Filed: Dec. 16, 2022

(86) PCT No.: PCT/KR2022/020633
§ 371 (c)(1),
(2) Date: Jun. 24, 2024

(87) PCT Pub. No.: WO2023/121160
PCT Pub. Date: Jun. 29, 2023

(65) Prior Publication Data

US 2025/0043786 A1 Feb. 6, 2025

(30) Foreign Application Priority Data

Dec. 24, 2021 (KR) ..... 10-2021-0187551
Dec. 14, 2022 (KR) ..... 10-2022-0175100

(51) Int. Cl.
*F04C 18/02* (2006.01)
*F04C 23/00* (2006.01)
(Continued)

(52) U.S. Cl.
CPC ..... *F04C 29/06* (2013.01); *F04C 18/0215* (2013.01); *F04C 23/008* (2013.01);
(Continued)

(58) Field of Classification Search
CPC .... F04C 18/0215; F04C 23/008; F04C 23/02; F04C 15/0023; F04C 27/005;
(Continued)

(56) References Cited

U.S. PATENT DOCUMENTS

2003/0000378 A1* 1/2003 Ahn ..... F16C 27/08 92/71
2013/0129551 A1* 5/2013 Tsubai ..... F04C 23/008 418/55.4
2020/0032798 A1* 1/2020 Her ..... F04C 18/0269

FOREIGN PATENT DOCUMENTS

JP 1991149381 A 6/1991
JP H0547447 U 6/1993
(Continued)

*Primary Examiner* — Theresa Trieu
(74) *Attorney, Agent, or Firm* — Shumaker, Loop & Kendrick, LLP; James D. Miller

(57) ABSTRACT

An electric compressor including a housing, a compression mechanism disposed in the housing and configured to compress a refrigerant, a motor configured to generate power required for the compression mechanism, a rotary shaft configured to transmit power from the motor to the compression mechanism, a bearing configured to support the rotary shaft, and an elastic member configured to press the rotary shaft toward the compression mechanism, thereby suppressing axial vibration of the rotary shaft during an operation, suppressing an increase in noise, and preventing damage to the bearing configured to support the rotary shaft.

9 Claims, 7 Drawing Sheets

(51) Int. Cl.

| | |
|---|---|
| ***F04C 23/02*** | (2006.01) |
| ***F04C 27/00*** | (2006.01) |
| ***F04C 29/00*** | (2006.01) |
| ***F04C 29/06*** | (2006.01) |

(52) U.S. Cl.
CPC ..... *F04C 23/02* (2013.01); *F04C 27/005* (2013.01); *F04C 29/0021* (2013.01); *F04C 2240/50* (2013.01); *F04C 2240/60* (2013.01)

(58) Field of Classification Search
CPC .... F04C 27/009; F04C 29/0021; F04C 29/06; F04C 2240/50; F04C 2240/52; F04C 2240/60
See application file for complete search history.

(56) References Cited

FOREIGN PATENT DOCUMENTS

| | | | | | |
|---|---|---|---|---|---|
| JP | 2000088023 | A | | 3/2000 | |
| JP | 2003028058 | A | | 1/2003 | |
| JP | 2011247209 | A | | 12/2011 | |
| JP | 2013108390 | A | | 6/2013 | |
| JP | 2017180415 | A | * | 10/2017 | ..... F04C 18/344 |
| JP | 2017193987 | A | * | 10/2017 | ..... F04C 18/02 |
| KR | 100748140 | B1 | | 8/2007 | |
| KR | 20120095711 | A | | 8/2012 | |
| KR | 101420524 | B1 | | 7/2014 | |

* cited by examiner

ELECTRIC COMPRESSOR

CROSS REFERENCE TO RELATED PATENT APPLICATIONS

This is a U.S. national phase patent application of PCT/KR2022/020633 filed Dec. 16, 2022 which claims the benefit of and priority to Korean Patent Application No. 10-2022-0175100 filed on Dec. 14, 2022 and Korean Patent Application No. 10-2021-0187551 filed on Dec. 24, 2021, the entire contents of each of which are incorporated herein by reference.

TECHNICAL FIELD

The present invention relates to an electric compressor, and more particularly, to an electric compressor capable of compressing a refrigerant with driving power of a motor.

BACKGROUND ART

In general, a compressor refers to a device for compressing a fluid such as a refrigerant gas and is applied to an air conditioning system for a building, an air conditioning system for a vehicle, or the like.

Depending on compression methods, the compressors may be classified into a reciprocating compressor configured to compress a refrigerant by reciprocating a piston, and a rotary compressor configured to compress a refrigerant while performing a rotational motion. Depending on power transmission methods, the reciprocating compressors may be classified into a crank compressor configured to transmit power to a plurality of pistons by using a crank, and a swash plate compressor configured to transmit power to a rotary shaft on which a swash plate is installed, and the rotary compressors may be classified into a vane rotary compressor using a rotating rotary shaft and a vane, and a scroll compressor using an orbiting scroll and a fixed scroll.

In addition, depending on operating methods, the compressors may be classified into a mechanical compressor using an engine, and an electric compressor using a motor.

FIG. 1 is a cross-sectional view illustrating an electric compressor in the related art.

With reference to FIG. 1 attached hereto, the electric compressor in the related art includes a housing 2', a compression mechanism 4' disposed in the housing 2' and configured to compress a refrigerant, a motor 6' configured to generate power required to operate the compression mechanism 4', and a rotary shaft 7' configured to transmit power from the motor 6' to the compression mechanism 4'.

In this case, the rotary shaft 7' includes a first end extending toward a side opposite to the compression mechanism 4' while penetrating the motor 6', and a second end extending toward the compression mechanism 4'. The first end is supported by a first radial bearing 91', and the second end is supported by a second radial bearing 92'.

Further, the first radial bearing 91' includes a first outer race supported on the housing 2', a first inner race accommodated in an inner peripheral portion of the first outer race and configured to support an outer peripheral surface of the first end, and first balls interposed between the first outer race and the first inner race.

The second radial bearing 92' includes a second outer race supported on the housing 2', a second inner race accommodated in an inner peripheral portion of the second outer race and configured to support an outer peripheral surface of the second end, and second balls interposed between the second outer race and the first inner race.

However, in the electric compressor in the related art, the rotary shaft 7' vibrates in an axial direction during an operation, which causes a problem in that noise increases, and the bearings for supporting the rotary shaft 7' are damaged.

SUMMARY

Accordingly, an object of the present invention is to provide an electric compressor capable of suppressing axial vibration of a rotary shaft during an operation, thereby suppressing an increase in noise and preventing damage to a bearing for supporting a rotary shaft.

In order to achieve the above-mentioned object, the present invention provides an electric compressor including: a housing; a compression mechanism disposed in the housing and configured to compress a refrigerant; a motor configured to generate power required for the compression mechanism; a rotary shaft configured to transmit power from the motor to the compression mechanism; a bearing configured to support the rotary shaft; and an elastic member configured to press the rotary shaft toward the compression mechanism.

The bearing may include a thrust bearing disposed between the elastic member and the rotary shaft.

The rotary shaft may include: a first end extending while penetrating the motor; and a second end extending toward a side opposite to the first end and connected to the compression mechanism, the housing may include a shaft receiving groove into which the first end, the elastic member, and the thrust bearing are inserted, the elastic member may be supported on a base surface of the shaft receiving groove, and the thrust bearing may be tightly attached to a tip surface of the first end by the elastic member.

The thrust bearing may be configured as a plate-shaped sliding bearing.

The bearing may further include a first radial bearing disposed in the shaft receiving groove and configured to support an outer peripheral surface of the first end.

The first radial bearing may be configured as a bushing type sliding bearing.

An inner diameter of the shaft receiving groove may be larger than an outer diameter of the sliding bearing, and an adapter may be disposed between an inner peripheral surface of the shaft receiving groove and an outer peripheral surface of the sliding bearing.

The inner diameter of the shaft receiving groove may be set to be at the same level as an outer diameter of the rolling bearing when the first radial bearing is configured as the rolling bearing.

The rotary shaft may include: a first end extending while penetrating the motor; and a second end extending toward a side opposite to the first end and connected to the compression mechanism, the first end may include: a first portion; and a second portion extending from the first portion toward a side opposite to the motor, an outer diameter of the first portion may be larger than an outer diameter of the second portion such that a stepped surface is formed between the first portion and the second portion, the bearing may include a first radial bearing configured to support an outer peripheral surface of the second portion, and the elastic member may be disposed between the first radial bearing and the stepped surface.

The bearing may further include a thrust bearing disposed between the elastic member and the stepped surface, the elastic member may be supported on the first radial bearing, and the thrust bearing may be tightly attached to the stepped surface by the elastic member.

The elastic member may be supported on the first radial bearing and the stepped surface.

The first radial bearing may include: an inner race supported on the outer peripheral surface of the second portion; an outer race configured to accommodate the inner race and supported on the housing; and balls interposed between the inner race and the outer race, and the elastic member may be supported on the inner race.

The electric compressor may further include: a second radial bearing configured to support an outer peripheral surface of the second end, in which the second radial bearing includes: an inner race fitted into the outer peripheral surface of the second end; an outer race configured to accommodate the inner race and supported on the housing, and balls interposed between the inner race and the outer race.

The inner race may include an inner track into which one side of the ball is inserted, the outer race may include an outer track into which the other side of the ball is inserted, the inner track may include: one side inner track surface disposed to be close to the compression mechanism based on a center of the ball; and the other side inner track surface disposed to be close to a side opposite to one side inner track surface, the outer track may include: one side outer track surface disposed to be close to the compression mechanism based on the center of the ball; and the other side outer track surface disposed to be close to a side opposite to one side outer track surface, and when the rotary shaft is pressed toward the compression mechanism, the inner race may be pressed toward the compression mechanism through the rotary shaft, such that the ball is also supported in an axial direction by the other side inner track surface and one side outer track surface.

The elastic member may be configured as one of a wave spring, a conical spring, and a wire spring.

An electric compressor according to the present invention includes a housing, a compression mechanism disposed in the housing and configured to compress a refrigerant, a motor configured to generate power required for the compression mechanism, a rotary shaft configured to transmit power from the motor to the compression mechanism, a bearing configured to support the rotary shaft, and an elastic member configured to press the rotary shaft toward the compression mechanism, thereby suppressing axial vibration of the rotary shaft during an operation, suppressing an increase in noise, and preventing damage to the bearing configured to support the rotary shaft.

DESCRIPTION OF AN EMBODIMENT

Hereinafter, an electric compressor according to the present invention will be described in detail with reference to the accompanying drawings.

Figure 1:
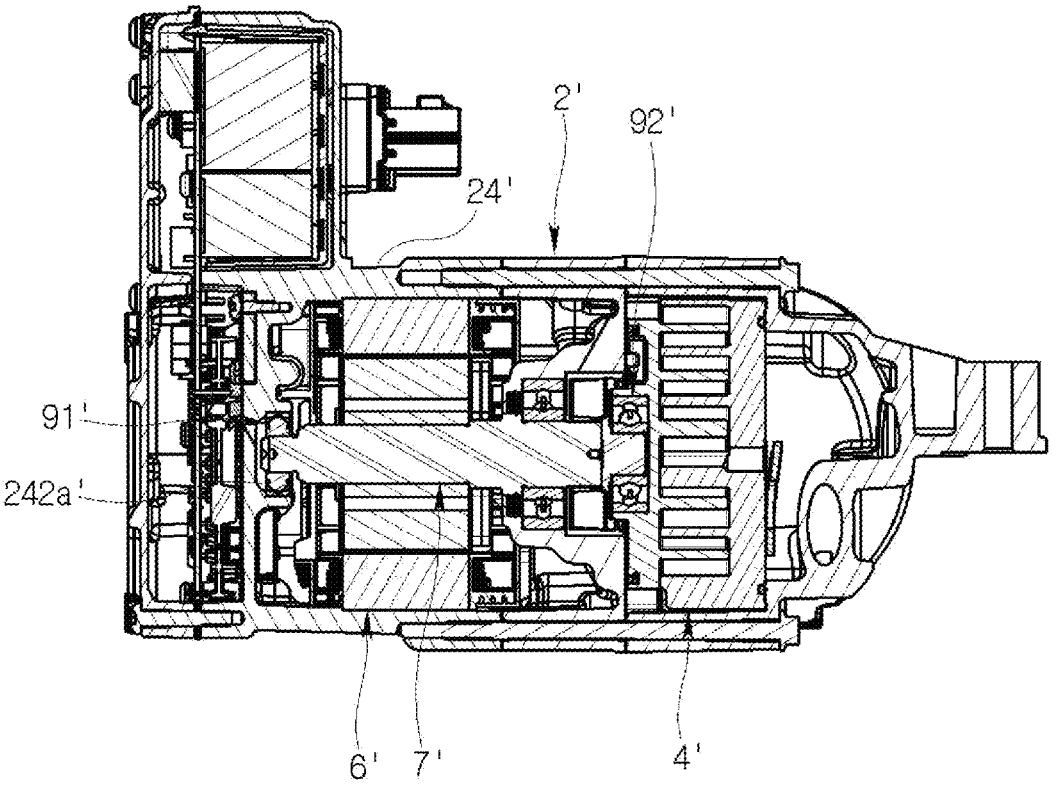
FIG. 1 PRIOR ART
FIG. 1 is a cross-sectional view illustrating an electric compressor in the related art.
Figure 2:
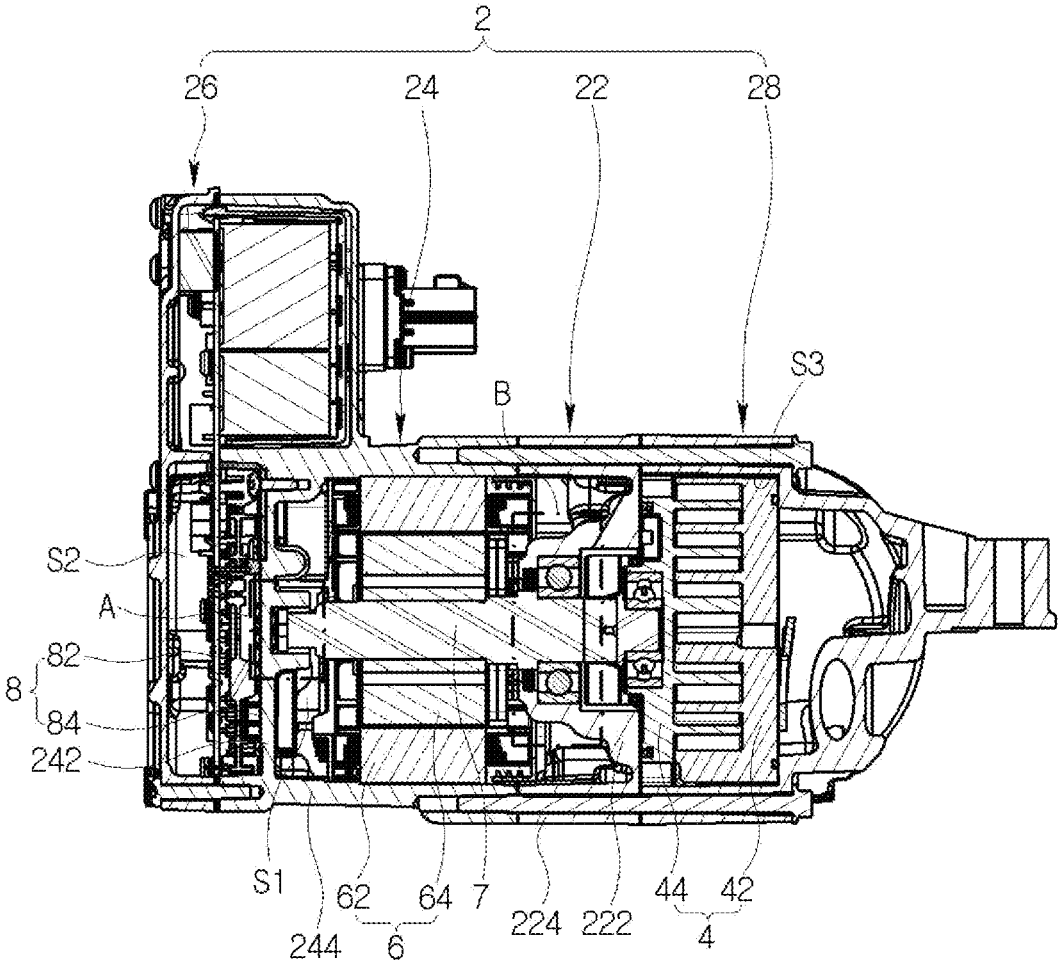
FIG. 2 is a cross-sectional view illustrating an electric compressor according to an embodiment of the present invention.
Figure 3:
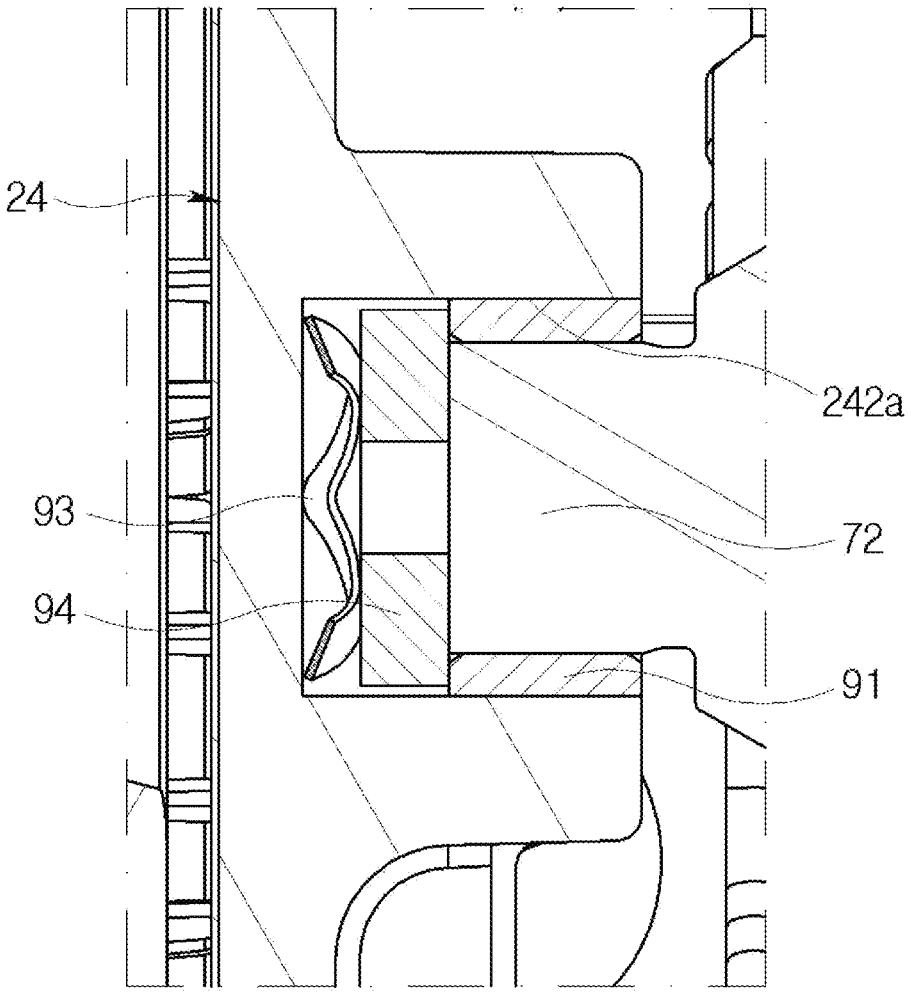
FIG. 3 is an enlarged view of part A in FIG. 2.
Figure 4:
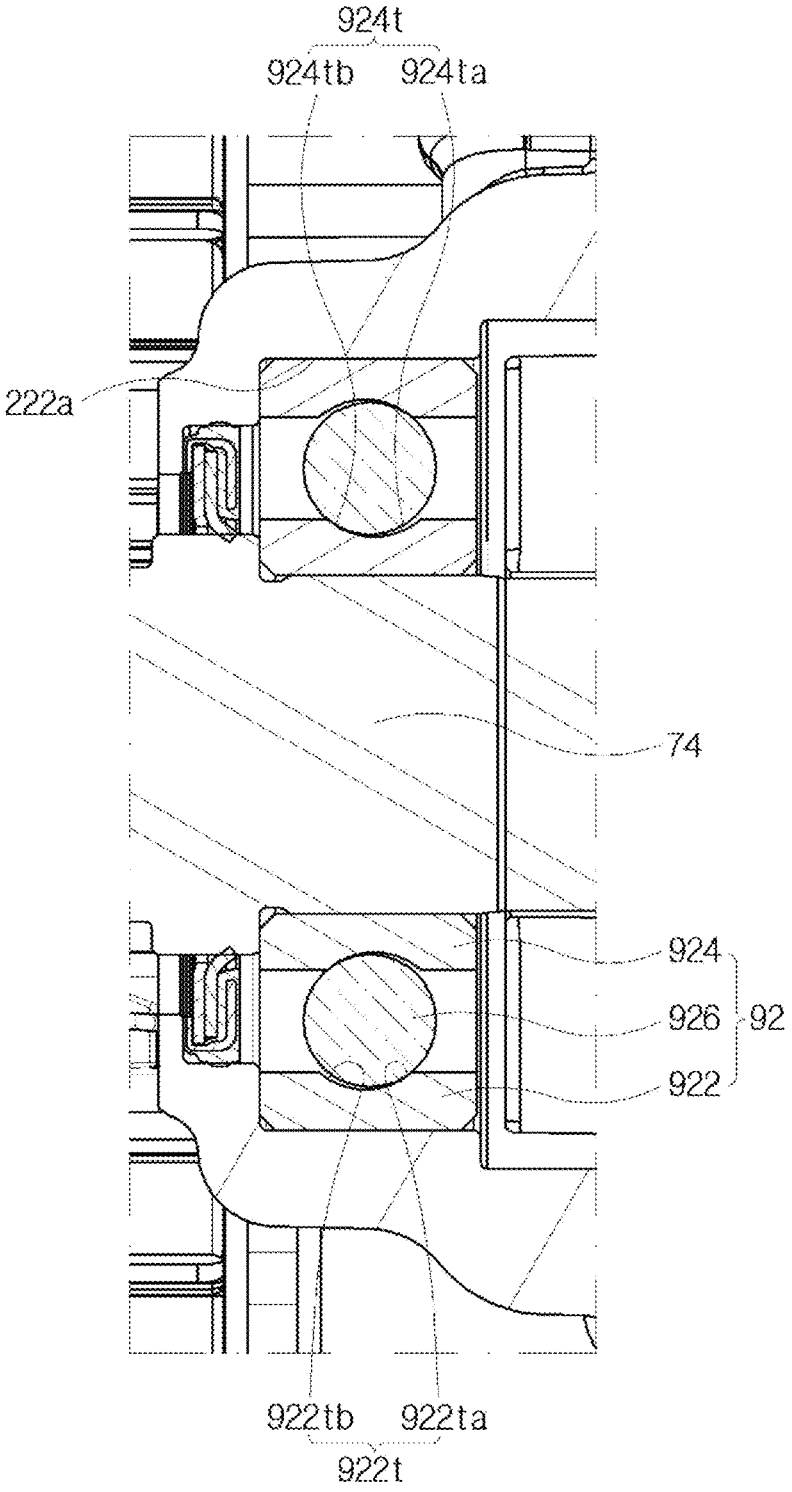
FIG. 4 is an enlarged view of part B in FIG. 2.

FIG. 2 is a cross-sectional view illustrating an electric compressor according to an embodiment of the present invention, FIG. 3 is an enlarged view of part A in FIG. 2, and FIG. 4 is an enlarged view of part B in FIG. 2.

With reference to FIGS. 2 to 4 attached hereto, the electric compressor according to the embodiment of the present invention may include a housing 2, a compression mechanism 4 disposed in the housing 2 and configured to compress a refrigerant, a motor 6 configured to generate power required for the compression mechanism 4, a rotary shaft 7 configured to transmit power from the motor 6 to the compression mechanism 4, bearings configured to support the rotary shaft 7, and an inverter 8 configured to control the motor 6.

The housing 2 may include a center housing 22, a front housing 24 coupled to the center housing 22 and configured to define a motor accommodation space S1 configured to accommodate the motor 6, an inverter cover 26 disposed at a side opposite to the center housing 22 based on the front housing 24, coupled to the front housing 24, and configured to define an inverter accommodation space S2 configured to accommodate the inverter 8, and a rear housing 28 disposed at a side opposite to the front housing 24 based on the center housing 22, coupled to the center housing 22, and configured to define a compression mechanism accommodation space S3 configured to accommodate the compression mechanism 4.

In this case, the center housing 22 may include a center housing partition wall 222 configured to separate the motor accommodation space S1 and the compression mechanism accommodation space S3, and a center housing annular wall 224 extending along an outer peripheral portion of the center housing partition wall 222. A shaft receiving hole 222*a* may be formed in the center housing partition wall 222, and a second end 74 of the rotary shaft 7, which will be described below, may be inserted into the shaft receiving hole 222*a*.

Further, the front housing 24 may include a front housing partition wall 242 configured to separate the motor accommodation space S1 and the inverter accommodation space S2, and a front housing annular wall 244 extending along an outer peripheral portion of the front housing partition wall 242 and fastened to the center housing annular wall 224. A shaft receiving groove 242*a* may be formed in the front housing partition wall 242, and a first end 72 of the rotary shaft 7 may be inserted into the shaft receiving groove 242*a*.

The compression mechanism 4 may include a fixed scroll 42 fixedly installed, and an orbiting scroll 44 engaging with the fixed scroll 42 to define a compression chamber together with the fixed scroll 42 and configured to perform an orbit motion by the rotary shaft 7. In this case, in the present embodiment, the compression mechanism 4 is configured as a so-called scroll type. However, the present invention is not limited thereto. The compression mechanism 4 may be configured as other types such as a reciprocating type and a vane rotary type.

The motor 6 may include a stator 62 supported on the front housing annular wall 244, and a rotor 64 positioned in the stator 62 and configured to be rotated by an interaction with the stator 62.

The rotary shaft 7 may include the first end 72 coupled to the rotary shaft 7, extending toward the side opposite to the compression mechanism 4 while penetrating the rotor 64, and inserted into the shaft receiving groove 242*a*, and the second end 74 extending toward the compression mechanism 4 and inserted into the shaft receiving hole 222*a*.

The bearings may include a first radial bearing 91 disposed in the shaft receiving groove 242*a* and configured to support an outer peripheral surface of the first end 72, and a second radial bearing 92 disposed in the shaft receiving hole 222*a* and configured to support an outer peripheral surface of the second end 74.

The first radial bearing 91 is configured as a bushing type sliding bearing, an outer peripheral surface of the first radial bearing 91 may be supported on an inner peripheral surface of the shaft receiving groove 242*a*, and an inner peripheral surface of the first radial bearing 91 may support the outer peripheral surface of the first end 72.

In this case, an outer diameter of the first end 72 may be equal to or smaller than an inner diameter of the first radial bearing 91, such that the first end 72 may be inserted into the first radial bearing 91 without being press-fitted.

Further, a coating layer may be provided on the inner peripheral surface of the first radial bearing 91 and made of a material such as polyether ether ketone (PEEK) or polytetrafluoroethylene (PTFE), for example.

The second radial bearing 92 may be configured as a rolling bearing including a second outer race 922 supported on an inner peripheral surface of the shaft receiving hole 222*a*, a second inner race 924 accommodated in an inner peripheral portion of the second outer race 922 and configured to support an outer peripheral surface of the second end 74, and second balls 926 interposed between the second outer race 922 and the second inner race 924.

In this case, an outer diameter of the second end 74 is somewhat larger than an inner diameter of the second inner race 924, such that the second end 74 may be press-fitted into the second inner race 924.

The second inner race 924 may include a second inner track 924*t* into which one side of the second ball 926 is inserted.

The second inner track 924*t* may include one side second inner track surface 924*ta* disposed to be close to the compression mechanism 4 based on a center of the second ball 926, and the other side second inner track surface 924*tb* disposed to be close to the side opposite to one side second inner track surface 924*ta* based on the center of the second ball 926.

The second outer race 922 may include a second outer track 922*t* into which the other side of the second ball 926 is inserted.

The second outer track 922*t* may include one side second outer track surface 922*ta* disposed to be close to the compression mechanism 4 based on the center of the second ball 926, and the other side second outer track surface 922*tb* disposed to be close to the side opposite to one side second outer track surface 922*ta* based on the center of the second ball 926.

In this case, because of tolerance or the like, the second inner track 924*t* and the second outer track 922*t* each have a size somewhat larger than a radius of curvature of the second ball 926, which may cause the second inner race 924 to vibrate in an axial direction based on the second outer race 922.

However, according to the present embodiment, an elastic member 93 and a thrust bearing 94 are provided as described above, such that the second ball 926 is supported even in the axial direction by the other side second inner track surface 924*tb* and one side second outer track surface 922*ta*, which suppresses the axial vibration of the second inner race 924. This configuration will be described in detail below.

Meanwhile, the bearings may further include the elastic member 93 configured to press the rotary shaft 7 toward the compression mechanism 4, and the thrust bearing 94 disposed between the elastic member 93 and the rotary shaft 7.

For example, the elastic member 93 may be configured as a wave spring.

Further, the elastic member 93 may be identical in the shaft receiving groove 242*a*, supported on a base surface of the shaft receiving groove 242*a*, and disposed to face a tip surface of the first end 72.

For example, the thrust bearing 94 may be configured as a plate-shaped sliding bearing.

Further, the thrust bearing 94 may be inserted into the shaft receiving groove 242*a*, interposed between the elastic member 93 and the tip surface of the first end 72, and tightly attached to the tip surface of the first end 72 by the elastic member 93.

Further, a coating layer may be provided on a surface of the thrust bearing 94 and made of a material such as polyether ether ketone (PEEK) or polytetrafluoroethylene (PTFE), for example.

The inverter 8 may include a substrate 82 on which a plurality of elements 84 required for controlling is mounted.

Hereinafter, an operational effect of the electric compressor according to the present embodiment will be described.

That is, when electric power is applied to the motor 6, the rotor 64 and the rotary shaft 7 transmit power to the compression mechanism 4 while rotating, and a low-temperature, low-pressure refrigerant may be introduced into the motor accommodation space S1. The refrigerant in the motor accommodation space S1 may be introduced into the compression mechanism 4, compressed to a high-temperature, high-pressure refrigerant, and then the refrigerant may be discharged to the outside of the housing 2.

In this process, the rotary shaft 7 may be supported by the first radial bearing 91 and the second radial bearing 92. However, the first radial bearing 91 and the second radial bearing 92, which are configured to support the rotary shaft 7 mainly in a radial rotation direction, have a limitation in supporting the rotary shaft 7 in the axial direction, which may cause the axial vibration.

According to the present embodiment, the elastic member 93 is provided in consideration of the above-mentioned situation. Therefore, as illustrated in FIG. 4, the rotary shaft 7 may be pressed toward the compression mechanism 4, and the second inner race 924 press-fitted into the rotary shaft 7 may be pressed toward the compression mechanism 4 together with the rotary shaft 7. Therefore, the second ball 926 may not only be supported between the second inner race 924 and the second outer race 922 in the radial rotation direction of the rotary shaft 7, but also be supported in the axial direction by the other side second inner track surface 924*tb* and one side second outer track surface 922*ta*, which may suppress the axial vibration of the rotary shaft 7 and prevent an increase in noise and damage to the second radial bearing 92.

Further, the vibration absorbency of the elastic member 93 may also suppress the axial vibration of the rotary shaft 7.

In this case, the thrust bearing 94 provided between the elastic member 93 and the rotary shaft 7 may prevent the elastic member 93 and the rotary shaft 7 from coming into direct contact with each other. Therefore, the elastic member 93 and the rotary shaft 7 may be prevented from damaging each other.

Further, in the present embodiment, the elastic member 93 is configured as a wave spring, and the thrust bearing 94 is configured as a plate-shaped sliding bearing. However, the present invention is not limited thereto. That is, for example, the elastic member 93 may be configured as a coil spring, a conical spring, or the like, and the thrust bearing 94 may be configured as a bearing with another shape. However, in order to reduce the size, the elastic member 93 may be configured as a wave spring, and the thrust bearing 94 may be configured as a plate-shaped sliding bearing.

Meanwhile, according to the present embodiment, because the first radial bearing 91 is configured as a bushing type sliding bearing, the first radial bearing 91 is less damaged by the axial vibration of the rotary shaft 7 in comparison with a case in which the first radial bearing 91 is configured as a rolling bearing, like the second radial bearing 92.

Further, because the first radial bearing 91 is configured as a bushing type sliding bearing, rotational inertia may decrease in comparison with the case in which the first radial bearing 91 is configured as a rolling bearing. Therefore, the efficiency of the electric compressor may be improved, the noise and vibration may be reduced, and the durability may be improved.

Further, because the first radial bearing 91 is configured as a bushing type sliding bearing, a diameter of the shaft receiving groove 242*a* may be reduced in comparison with the case in which the first radial bearing 91 is configured as a rolling bearing. Therefore, the weight and costs of the electric compressor may be reduced.

In this case, according to the present embodiment, the first radial bearing 91 is configured as a sliding bearing, and an inner diameter of the shaft receiving groove 242*a* corresponds to an outer diameter of the first radial bearing 91 of the sliding bearing type. However, the present invention is not limited thereto.

Figure 5:
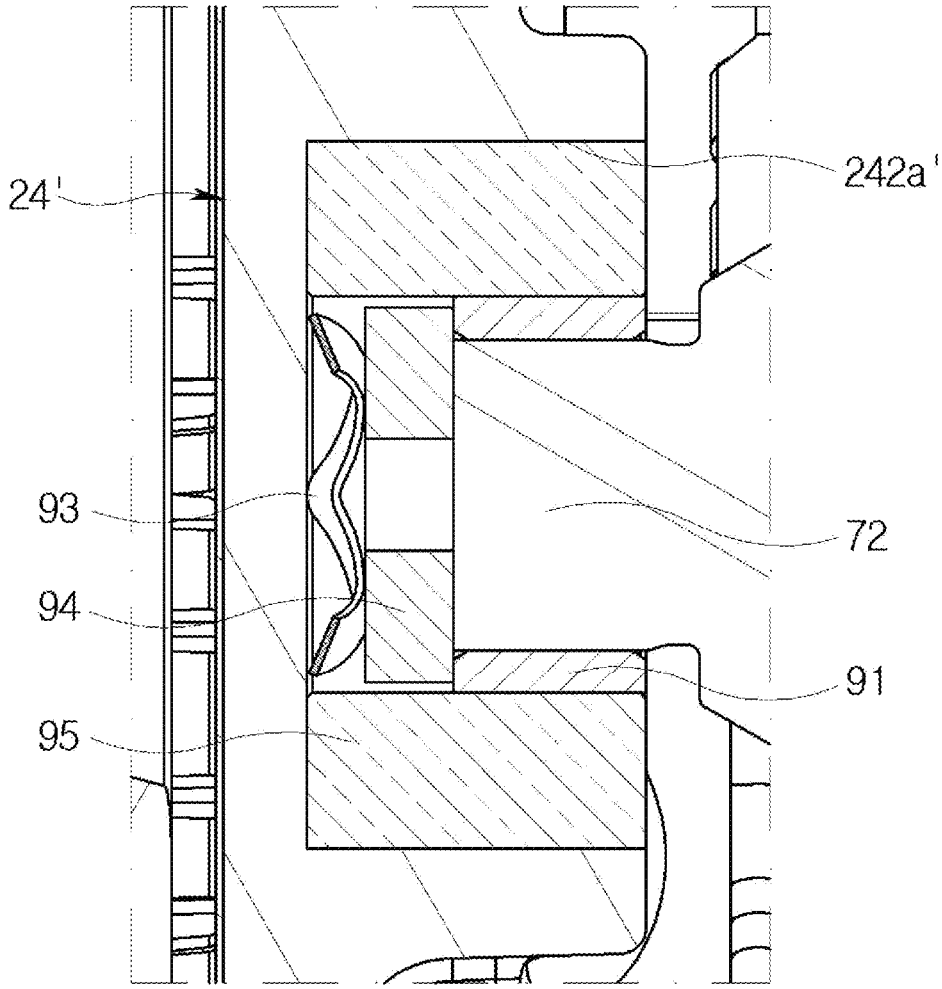
FIGS. 5 to 7 are cross-sectional views illustrating a shaft receiving groove in an electric compressor according to another embodiment of the present invention.

For example, in an electric compressor according to another embodiment of the present invention, with reference to FIG. 5 illustrating a shaft receiving groove 242*a*', the first radial bearing 91 is configured as a sliding bearing, as in the above-mentioned embodiment, and an inner diameter of the shaft receiving groove 242*a*' may be larger than an outer diameter of the first radial bearing 91. That is, the inner diameter of the shaft receiving groove 242*a*' may be set to be at the same level as the outer diameter of the first radial bearing 91' of the rolling bearing type (the first radial bearing 91 in the related art). Instead, an adapter 95 may be provided between an inner peripheral surface of the shaft receiving groove 242*a*' and an outer peripheral surface of the first radial bearing 91 of the sliding bearing type. In this case, the front housing 24 of the electric compressor using the first radial bearing 91 of the sliding bearing type and the front housing 24' of the electric compressor using the first radial bearing 91' of the rolling bearing type may be used in common, which may cause an increase in costs caused by the dualization of the specifications.

Alternatively, although not illustrated separately, the inner diameter of the shaft receiving groove 242*a*' may be set to be at the same level as the outer diameter of the first radial bearing 91' of the rolling bearing type, and the first radial bearing 91' of the rolling bearing type may be used instead of the adapter 95 and the first radial bearing 91 of the sliding type. That is, the first radial bearing 91' of the rolling bearing type may include a first outer race supported on an inner peripheral surface of the shaft receiving groove 242*a*', a first inner race accommodated in an inner peripheral portion of the first outer race and configured to support the outer peripheral surface of the first end 72, and first balls interposed between the first outer race and the first inner race. In this case, even though the first radial bearing 91' is configured as a rolling bearing relatively vulnerable to the axial vibration of the rotary shaft 7, the elastic member 93 may prevent damage to the first radial bearing 91' of the rolling bearing type caused by the axial vibration of the rotary shaft 7. However, in order to obtain the various effects described above, the first radial bearing may be configured as a sliding bearing.

Meanwhile, according to the present embodiment, the elastic member 93 is provided between the base surface of the shaft receiving groove 242*a* and the tip surface of the first end 72 of the rotary shaft 7. However, the present invention is not limited thereto.

Figure 6:
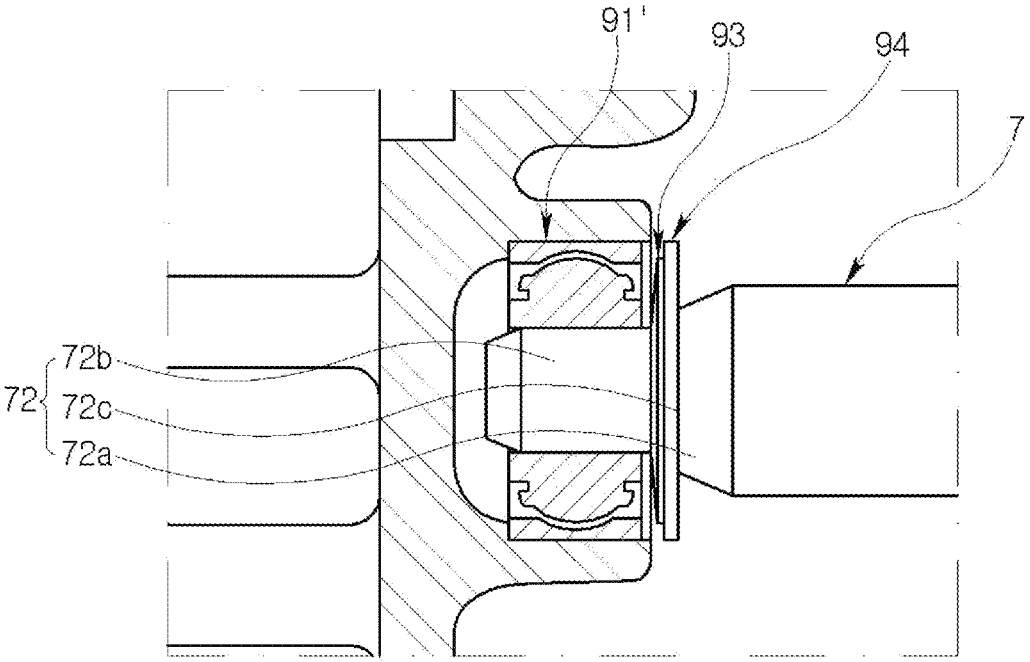

That is, for example, as illustrated in FIG. 6, the first end 72 of the rotary shaft 7 may include a first portion 72*a*, and a second portion 72*b* extending from the first portion 72*a* toward the side opposite to the motor. An outer diameter of the first portion 72*a* is larger than an outer diameter of the second portion 72*b*, such that a stepped surface 72*c* may be formed between the first portion 72*a* and the second portion 72*b*. In this case, the first radial bearing 91' may support an outer peripheral surface of the second portion 72*b*, the elastic member 93 and the thrust bearing 94 may be provided between the first radial bearing 91' and the stepped surface 72*c*, the elastic member 93 may be supported by the first radial bearing 91', and the thrust bearing 94 may be tightly attached to the stepped surface 72*c* by the elastic member 93. In this case, because the elastic member 93 may rotate, the elastic member 93 may be supported on the first inner race of the first radial bearing 91' to reduce friction with the first radial bearing 91'.

Meanwhile, in the embodiment illustrated in FIG. 6, the thrust bearing 94 is provided. However, the present invention is not limited thereto. That is, as illustrated in FIG. 7, the elastic member 93 may be supported by the first radial bearing 91' and the stepped surface 72*c* of the first end 72 of the rotary shaft 7 without the thrust bearing 94.

Figure 7:
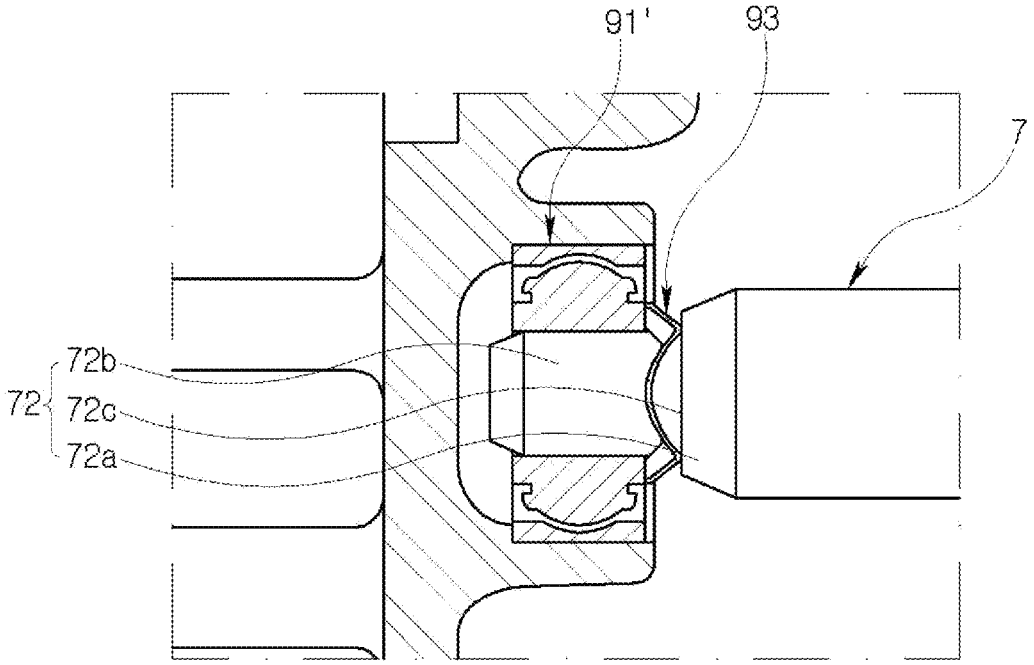

In this case, the elastic member 93 in the embodiment illustrated in FIG. 6 is configured as a conical spring, and the elastic member 93 in the embodiment illustrated in FIG. 7 is configured as a wave spring. However, the present invention is not limited thereto. The elastic member 93 may have other springs.

The invention claimed is:

1. An electric compressor comprising:

a housing;

a compression mechanism disposed in the housing and configured to compress a refrigerant;

a motor configured to generate power required for the compression mechanism;

a rotary shaft configured to transmit power from the motor to the compression mechanism;

a bearing configured to support the rotary shaft; and an elastic member configured to press the rotary shaft toward the compression mechanism, wherein the bearing further comprises a thrust bearing disposed between the elastic member and the rotary shaft, the rotary shaft further comprises a first end extending while penetrating the motor, and a second end extending toward a side opposite to the first end and connected to the compression mechanism, the housing further comprises a shaft receiving groove into which the first end of the rotary shaft, the elastic member, and the thrust bearing are inserted, the elastic member is supported on a base surface of the shaft receiving groove, the thrust bearing is tightly attached to a tip surface of the first end of the rotary shaft by the elastic member, the bearing further comprises a first radial bearing disposed in the shaft receiving groove and is configured to support an outer peripheral surface of the first end of the rotary shaft, the first radial bearing is configured as a bushing type sliding bearing, and an inner diameter of the shaft receiving groove is larger than an outer diameter of the sliding bearing, and an adapter is disposed between an inner peripheral surface of the shaft receiving groove and an outer peripheral surface of the sliding bearing.

2. The electric compressor of claim 1, wherein the thrust bearing is configured as a plate-shaped sliding bearing.

3. The electric compressor of claim 1, wherein the inner diameter of the shaft receiving groove is set to be at a same level as an outer diameter of the first radial bearing.

4. The electric compressor of claim 1, further comprising:

a second radial bearing configured to support an outer peripheral surface of the second end of the rotary shaft, wherein the second radial bearing further comprises:

an inner race fitted into the outer peripheral surface of the second end of the rotary shaft;

an outer race configured to accommodate the inner race and supported on the housing; and balls interposed between the inner race and the outer race.

5. The electric compressor of claim 4, wherein the inner race further comprises an inner track into which a first side of each of the balls is inserted, wherein the outer race further comprises an outer track into which a second side of each of the balls is inserted, wherein the inner track further comprises:

a first side inner track surface disposed to be close to the compression mechanism based on a center of the balls; and a second side inner track surface disposed to be close to a side opposite to the first side inner track surface, wherein the outer track further comprises:

a first side outer track surface disposed to be close to the compression mechanism based on the center of the balls; and a second side outer track surface disposed to be close to a side opposite to the first side outer track surface, and wherein when the rotary shaft is pressed toward the compression mechanism, the inner race is pressed toward the compression mechanism through the rotary shaft, such that each of the balls is also supported in an axial direction by the second side inner track surface and the first side outer track surface.

6. The electric compressor of claim 1, wherein the elastic member is configured as one of a wave spring, a conical spring, and a wire spring.

7. An electric compressor comprising:

a housing;

a compression mechanism disposed in the housing and configured to compress a refrigerant;

a motor configured to generate power required for the compression mechanism;

a rotary shaft configured to transmit power from the motor to the compression mechanism;

a bearing configured to support the rotary shaft; and an elastic member configured to press the rotary shaft toward the compression mechanism, wherein the rotary shaft further comprises:

a first end extending while penetrating the motor; and a second end extending toward a side opposite to the first end and connected to the compression mechanism, wherein the first end further comprises:

a first portion; and a second portion extending from the first portion toward a side opposite to the motor, wherein an outer diameter of the first portion is larger than an outer diameter of the second portion such that a stepped surface is formed between the first portion and the second portion, wherein the bearing further comprises a first radial bearing configured to support an outer peripheral surface of the second portion, and wherein the elastic member is disposed between the first radial bearing and the stepped surface.

8. The electric compressor of claim 7, wherein the bearing further comprises a thrust bearing disposed between the elastic member and the stepped surface, wherein the elastic member is supported on the first radial bearing, and wherein the thrust bearing is tightly attached to the stepped surface by the elastic member.

9. The electric compressor of claim 7, wherein the elastic member is supported on the first radial bearing and the stepped surface.

* * * * *